US008266870B1

(12) United States Patent
Stravitz

(10) Patent No.: US 8,266,870 B1
(45) Date of Patent: Sep. 18, 2012

(54) WASTE DISPOSAL DEVICES WITH MANUAL CONTROL

(76) Inventor: David M Stravitz, New York, NY (US)

( * ) Notice: Subject to any disclaimer, the term of this patent is extended or adjusted under 35 U.S.C. 154(b) by 0 days.

(21) Appl. No.: 13/172,968

(22) Filed: Jun. 30, 2011

Related U.S. Application Data

(60) Provisional application No. 61/362,159, filed on Jul. 7, 2010.

(51) Int. Cl.
*B65B 7/12* (2006.01)

(52) U.S. Cl. ..... 53/370; 53/567; 53/483

(58) Field of Classification Search ..... 53/370, 53/567, 576, 577, 459, 469, 483
See application file for complete search history.

(56) References Cited

U.S. PATENT DOCUMENTS

| | | | | |
|---|---|---|---|---|
| 2,946,474 | A | 7/1960 | Knapp | |
| 4,470,220 | A | 9/1984 | Sudo | |
| 4,576,252 | A | 3/1986 | Omata | |
| 4,869,049 | A * | 9/1989 | Richards et al. | 53/459 |
| 5,125,526 | A * | 6/1992 | Sumanis | 220/263 |
| 5,444,877 | A | 8/1995 | Kumarasurier | |
| 5,535,913 | A * | 7/1996 | Asbach et al. | 220/495.08 |
| 5,590,512 | A * | 1/1997 | Richards et al. | 53/567 |
| 5,794,277 | A | 8/1998 | Jones | |
| 5,813,200 | A * | 9/1998 | Jacoby et al. | 53/567 |
| 6,024,238 | A | 2/2000 | Jaros | |
| 6,128,890 | A | 10/2000 | Firth | |
| 6,145,283 | A | 11/2000 | Noordenbos | |
| 6,170,240 | B1 * | 1/2001 | Jacoby et al. | 53/567 |
| 6,370,847 | B1 | 4/2002 | Jensen et al. | |
| 6,516,588 | B2 * | 2/2003 | Jensen et al. | 53/459 |
| 6,561,055 | B1 | 5/2003 | Turk | |
| 6,612,099 | B2 | 9/2003 | Stravitz | |
| 6,626,316 | B2 | 9/2003 | Yang | |
| 6,719,194 | B2 | 4/2004 | Richards | |
| 6,804,930 | B2 | 10/2004 | Stravitz | |
| 6,851,251 | B2 | 2/2005 | Stravitz | |
| 7,114,314 | B2 | 10/2006 | Stravitz | |
| 7,146,785 | B2 | 12/2006 | Stravitz | |
| 7,316,100 | B2 | 1/2008 | Stravitz et al. | |
| 7,374,060 | B2 | 5/2008 | Yang et al. | |
| 7,434,377 | B2 | 10/2008 | Stravitz et al. | |
| 7,503,152 | B2 | 3/2009 | Stravitz et al. | |
| 7,503,159 | B2 | 3/2009 | Stravitz et al. | |
| 7,617,659 | B2 | 11/2009 | Stravitz et al. | |
| 7,708,188 | B2 | 5/2010 | Stravitz et al. | |
| 7,712,285 | B2 | 5/2010 | Stravitz et al. | |
| 7,963,414 | B1 * | 6/2011 | Stravitz | 220/264 |
| 2002/0038535 | A1 * | 4/2002 | Jensen et al. | 53/459 |
| 2004/0020175 | A1 * | 2/2004 | Stravitz | 53/567 |
| 2006/0237461 | A1 * | 10/2006 | Chomik et al. | 220/495.06 |
| 2007/0157581 | A1 * | 7/2007 | Webb et al. | 53/576 |

(Continued)

*Primary Examiner* — Sameh H. Tawfik
(74) *Attorney, Agent, or Firm* — Brian Roffe

(57) ABSTRACT

Waste disposal device includes a container defining a waste-receiving compartment having an opening, a lid connected to the container and having a closed position covering the opening of the container and an open position in which the opening is exposed, and a twisting assembly that engages with and twists or untwists a bag or tubing that extends through the twisting assembly and into which waste is inserted. A manual actuator or controller has a first position in engagement with the twisting assembly to enable manual rotation of the twisting assembly and a second position out of engagement with the twisting assembly. When the manual actuator is in the first position, the twisting assembly is manually rotatable in at least one direction, and possibly both, and in the second position, the manual actuator is freely movable.

23 Claims, 12 Drawing Sheets

U.S. PATENT DOCUMENTS

2010/0005759 A1 1/2010 Stravitz
2010/0005762 A1 1/2010 Stravitz
2010/0006712 A1* 1/2010 Stravitz ..... 248/99

* cited by examiner

WASTE DISPOSAL DEVICES WITH MANUAL CONTROL

CROSS-REFERENCE TO RELATED APPLICATION

This application claims priority of U.S. provisional patent application Ser. No. 61/362,159 filed Jul. 7, 2010, incorporated by reference herein.

FIELD OF THE INVENTION

The present invention relates generally to improvements to waste disposal devices including a control mechanism that enables at least manual control of an access opening into a bag or tubing into which waste is deposited, such as through a membrane.

BACKGROUND OF THE INVENTION

Numerous waste disposal devices exist including those disclosed in U.S. Pat. Nos. 6,612,099, 6,804,930, 6,851,251, 7,114,314, 7,146,785, 7,316,100, 7,434,377, 7,503,152, 7,503,159, 7,617,659, 7,708,188 and 7,712,285, all of which are incorporated by reference herein. Additionally, innovative waste disposal devices are disclosed in U.S. patent application Ser. No. 12/637,252 filed Dec. 14, 2009, now U.S. Pat. No. 7,963,414, also incorporated by reference herein.

In addition, waste disposal devices are disclosed in U.S. patent application Ser. No. 12/172,715 filed Jul. 14, 2008, 12/172,758 filed Jul. 14, 2008 and 12/172,793 filed Jul. 14, 2008, as well as U.S. provisional patent application Ser. Nos. 61/366,221 filed Jul. 21, 2010, 61/362,183 filed Jul. 7, 2010, and 61/409,188 filed Nov. 2, 2010, all of which are incorporated by reference herein. Non-provisional applications of the '221 and '183 applications are being simultaneously filed, and have been assigned Ser. Nos. 13/172,976 and 13/173,001, respectively, and are incorporated by reference herein.

Some of these waste disposal devices include a twisting assembly arranged in a container to form a twist in a bag or tubing into which waste is inserted through a membrane associated with the twisting assembly. Automatic twisting of the bag or tubing is provided, e.g., upon closure of a lid that results in rotation of the twisting assembly through a gear-containing rotation mechanism. On the other hand, when the lid is opened, the same rotation mechanism prevents untwisting of the bag or tubing, thereby providing the advantage of maintaining a twist in the bag or tubing and sealing in odor from the deposited waste.

It has now been found by the inventor herein, and not believed to have been previously appreciated, that it would be desirable to enable the twisting assembly to be additionally manually controlled to form a twist in the bag or tubing and/or to slightly open a previously formed twist to facilitate a better insertion of waste into the bag or tubing.

OBJECTS AND SUMMARY OF THE INVENTION

Therefore, it is an object of the present invention to provide a waste disposal device including a twisting assembly for forming a twist in a bag or tubing into which waste is deposited and which enables the twisting assembly to be manually controlled to, for example, form a stronger twist in the bag or tubing and/or to slightly or fully open a previously formed twist to facilitate a better insertion of waste into the bag or tubing. The manual control may be in addition to any type of existing automatic control of the twisting assembly, such as rotation of the twisting assembly upon closure or opening of the lid.

A waste disposal device in accordance with the invention includes a container defining a waste-receiving compartment having an opening, a lid connected to the container and having a first, closed position covering the opening of the container and a second, open position in which the opening is exposed, and a twisting assembly arranged in the container to engage with and twist or untwist a bag or tubing that extends through the twisting assembly and into which waste is inserted. The waste disposal device also includes a manual actuator or controller that has a first position in engagement with the twisting assembly to enable manual rotation of the twisting assembly and a second position out of engagement with the twisting assembly. As such, when the manual actuator is in the first position, the twisting assembly is manually rotatable and in the second position, the manual actuator is freely movable.

Another embodiment of a waste disposal device in accordance with the invention includes a container defining a waste-receiving compartment having an opening and an outer wall having an elongate slot, a lid connected to the container and having a first, closed position covering the opening of the container and a second, open position in which the opening is exposed, and a twisting assembly arranged in the container to engage with and twist or untwist a bag or tubing that extends through the twisting assembly and into which waste is inserted. A manual actuator is movable longitudinally in the slot and into and out of engagement with the twisting assembly to enable manual rotation of the twisting assembly. When the manual actuator is in engagement with the twisting assembly, the twisting assembly is manually rotatable by moving the actuator longitudinally in the slot, in only one longitudinal direction in the slot or in both directions, and when the manual actuator is out of engagement with the twisting assembly, it is freely movable in the slot.

With a variation of the waste disposal devices described above, the invention provides a method for controlling migration of odor and bacteria through an opening of a bag or tubing in a container of the waste disposal device. This method entails connecting a lid to the container, the lid having a first, closed position and a second, open position, arranging a twisting assembly in the container to engage with and twist or untwist the bag or tubing, enabling manual rotation of the twisting assembly via an actuator, and arranging a transparent window on the container in a position relative to the twisting assembly such that a twist or knot in the bag or tubing formed by the twisting assembly is viewable through the window. As such, a user can prevent passage of odor and bacteria from an interior of the bag or tubing through the opening of the bag, prevent migration of odor and bacteria from an inside of the lid and/or prevent suction of odor and bacteria from the bag or tubing when the lid is moved from its first position to its second position by (prior to moving the lid from its first position to its second position or after insertion of waste into the bag or tubing) ascertaining whether a twist or knot is present in the bag or tubing by looking through the window and when a twist or knot in the bag or tubing is not present, moving the actuator to cause rotation of the twisting assembly and formation of a twist or knot in the bag or tubing. Then, if after the waste has been inserted and the lid has been closed, the waste disposal device is maintained in a condition in which the bag or tubing is not open and thus odor and bacteria does not escape from the interior of the bag and fester on the inner surface of the lid. If prior to opening the lid, the lid can be opened without causing suction of odor and bacteria from the open bag or tubing into the room.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
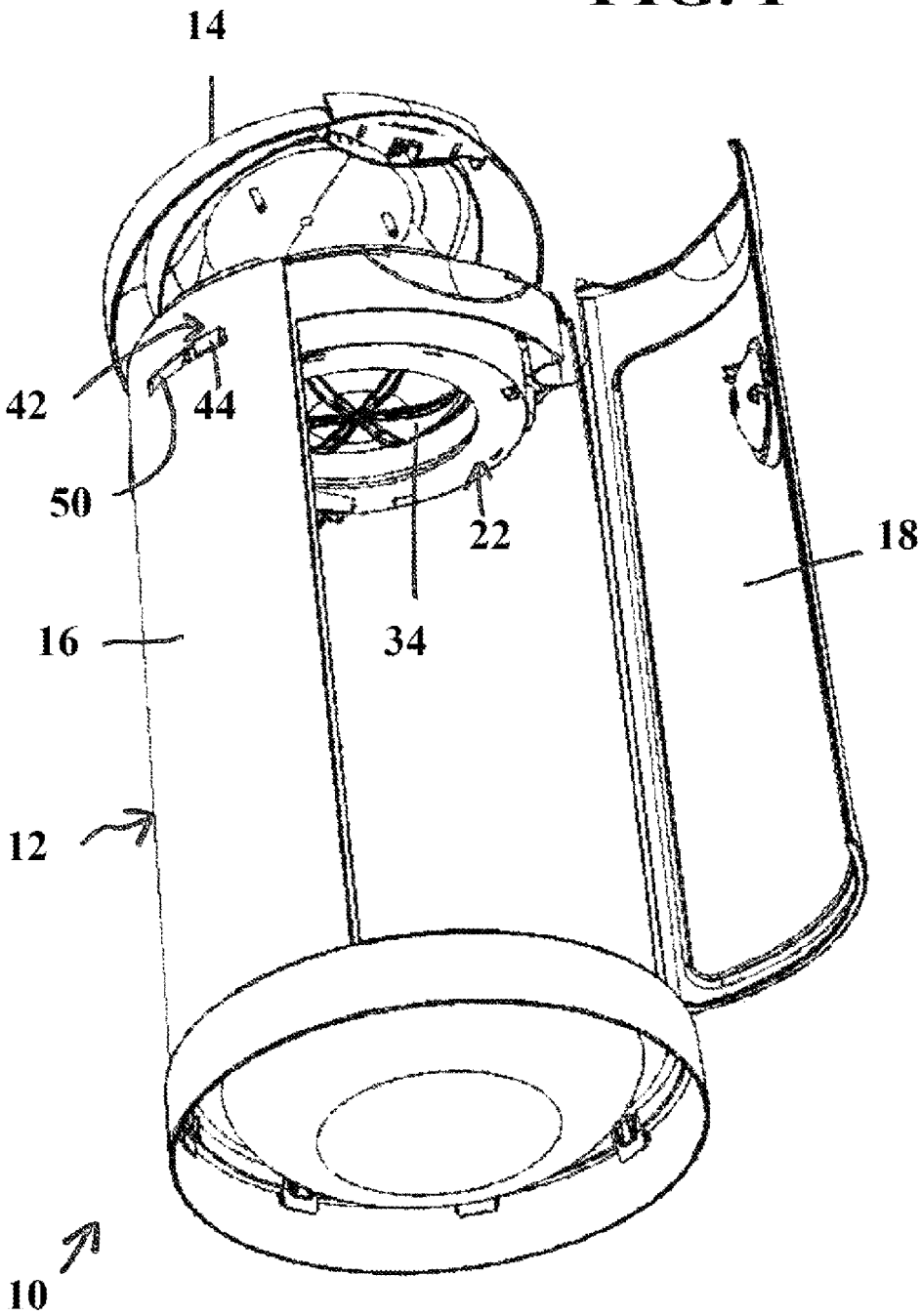
FIG. 1 is a perspective view of a waste disposal device in accordance with the invention.

Referring to the accompanying drawings wherein like reference numbers refer to the same or similar elements, a first embodiment of a waste disposal device 10 in accordance with the invention is shown in FIG. 1 and generally includes a container 12 defining an interior compartment and a lid 14 pivotally mounted to the container 12. Container 12 includes a tubular wall 16 having an access door 18 that facilitates access to the interior compartment of the container 12, for example, to remove a waste-containing bag or tubing therefrom.

A general feature of waste disposal device 10 is that there is rotation of a mechanism which engages with a bag or tubing relative to a stationary support, support member or cartridge that supports or retains the bag or tubing into which the waste is placed to thereby cause the formation of a twist in the bag or tubing. Rotation of this mechanism would occur, for example, after insertion of waste to thereby form a twist above the inserted waste and inhibit release of odors from the waste.

Figure 2:
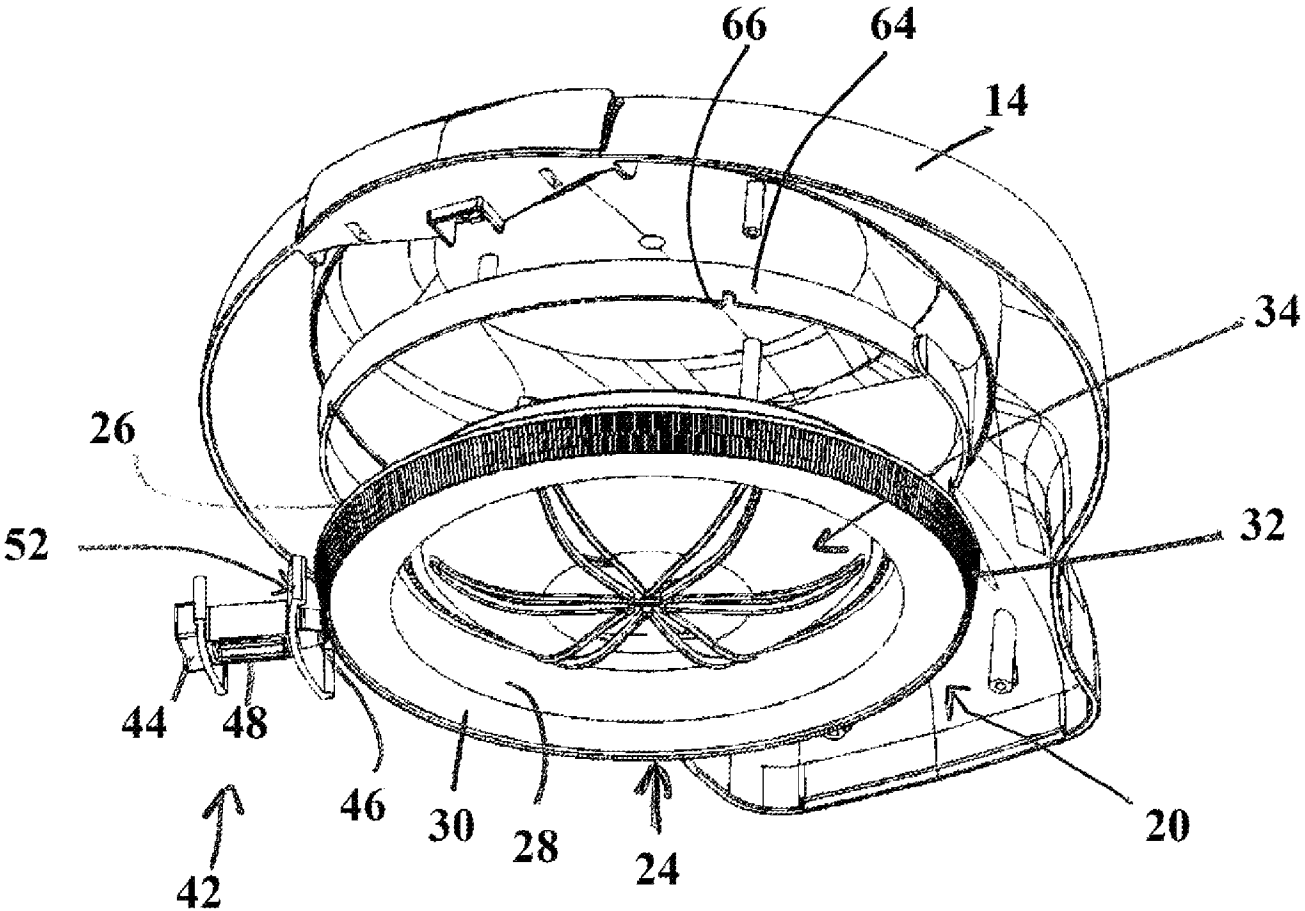
FIG. 2 is a perspective view from the interior of the waste disposal device shown in FIG. 1.
Figure 3:
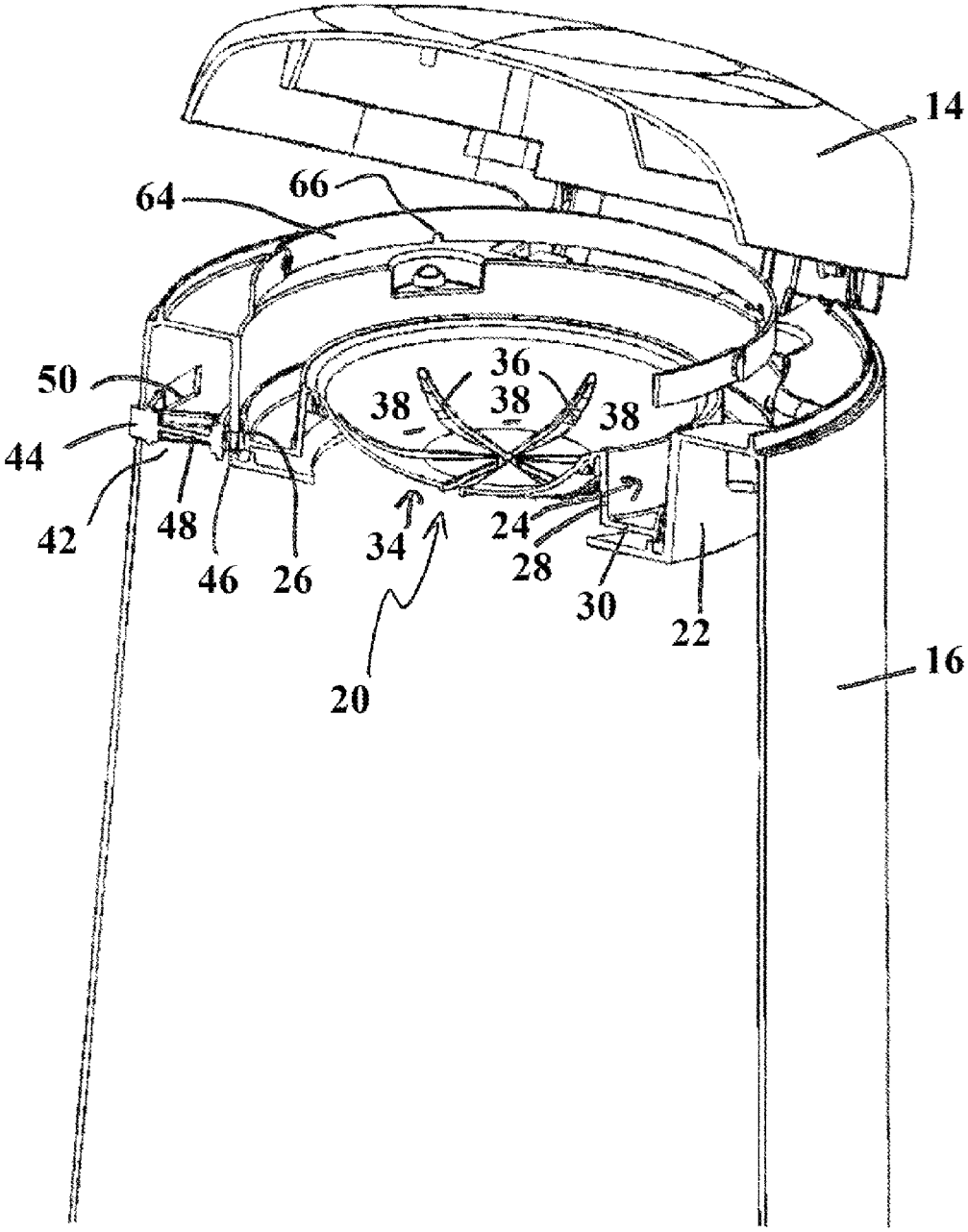
FIG. 3 is a perspective view, partly broken away, showing an interior of the waste disposal device shown in FIG. 1.

To implement this technique, a twisting assembly 20 (see FIGS. 2-6, 8 and 9) is movably seated on a support flange 22 of the container 12 and includes a twisting member 24 (see FIGS. 2-6, 8 and 9). As shown in FIGS. 1 and 3, support flange 22 defines a waste-receiving opening of the container 12. Twisting member 24 (see FIGS. 2-8) includes a substantially tubular outer wall 26 (see FIGS. 2-6), a substantially tubular inner wall 28 (see FIGS. 2, 3, 5 and 6), a substantially planar bottom support wall 30 (see FIGS. 2-6) and a series of teeth formed on the outer wall 26 (see FIGS. 2-6, 8 and 9) to thereby constitute a gear rim 32 (see FIG. 2). The gear rim 32 may be formed integral or unitary with the twisting member 24 or separate therefrom and then attached thereto, whether to the outer wall 26 or another part of the twisting member 24 (see FIG. 2).

Figure 4:
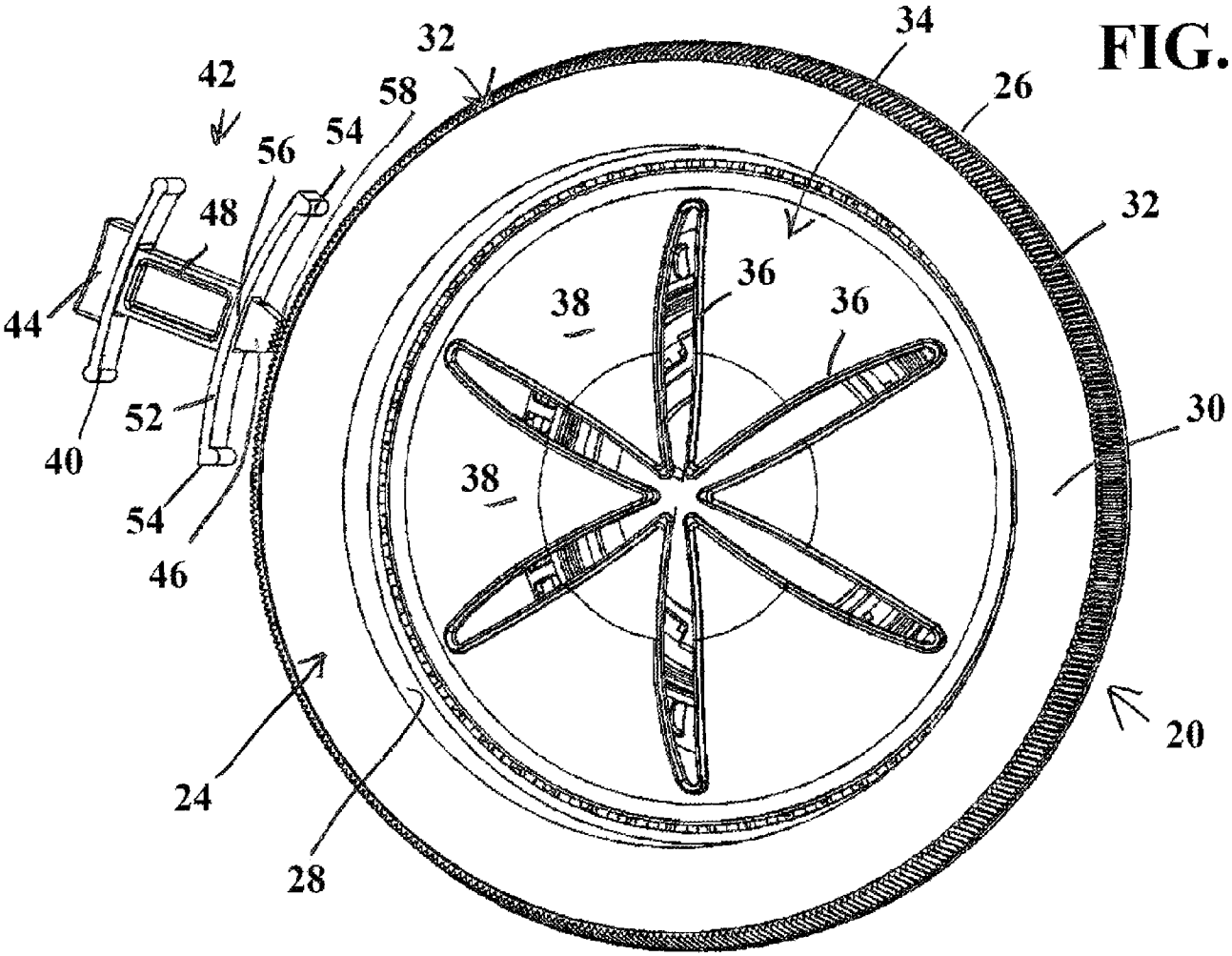
FIG. 4 is a perspective view showing engagement of a first embodiment of a manual control device and a twisting assembly in the waste disposal device shown in FIG. 1.
Figure 5:
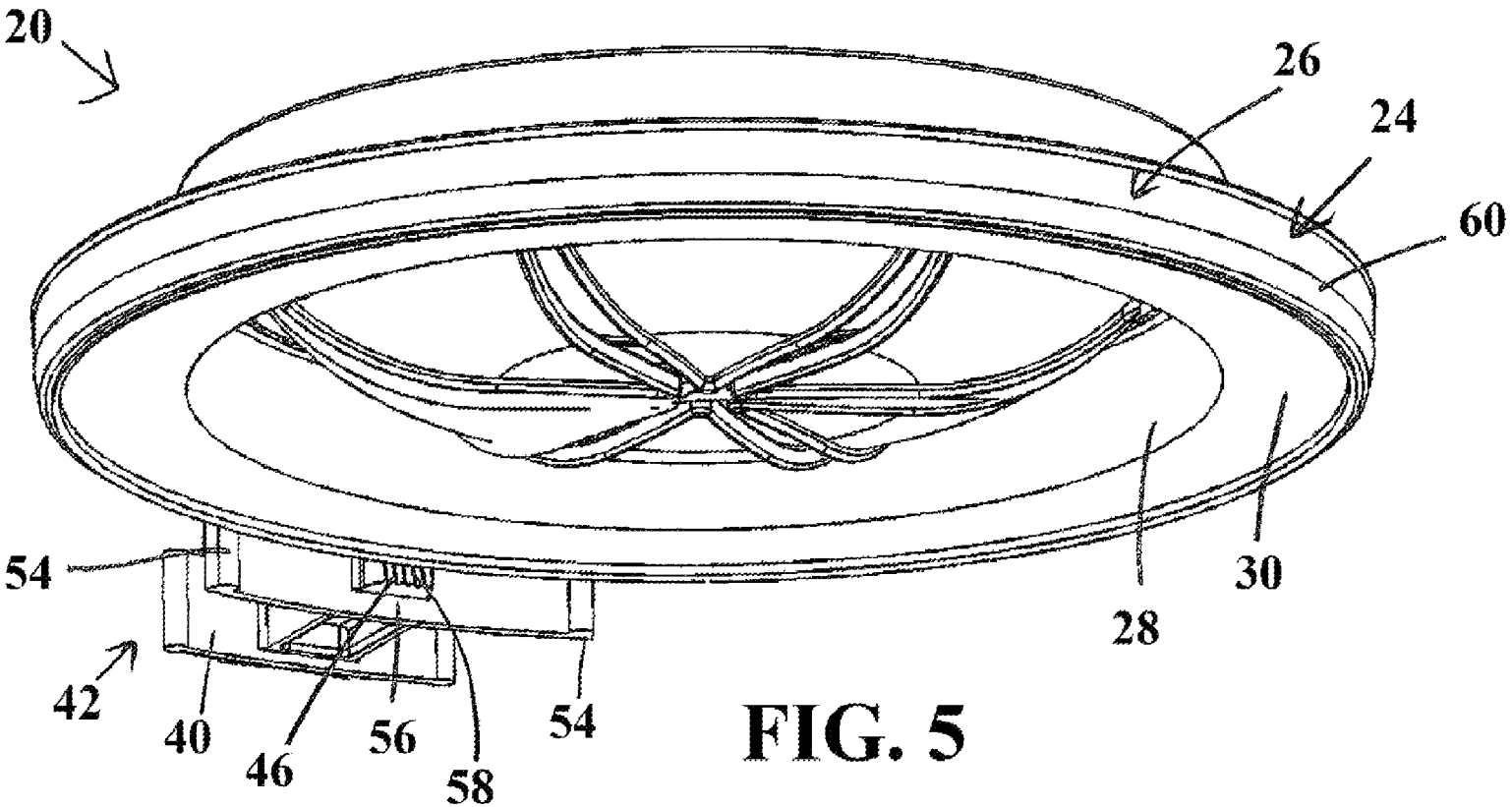
FIG. 5 is a perspective view showing engagement of a second embodiment of a manual control device and a twisting assembly in the waste disposal device shown in FIG. 1.
Figure 6:
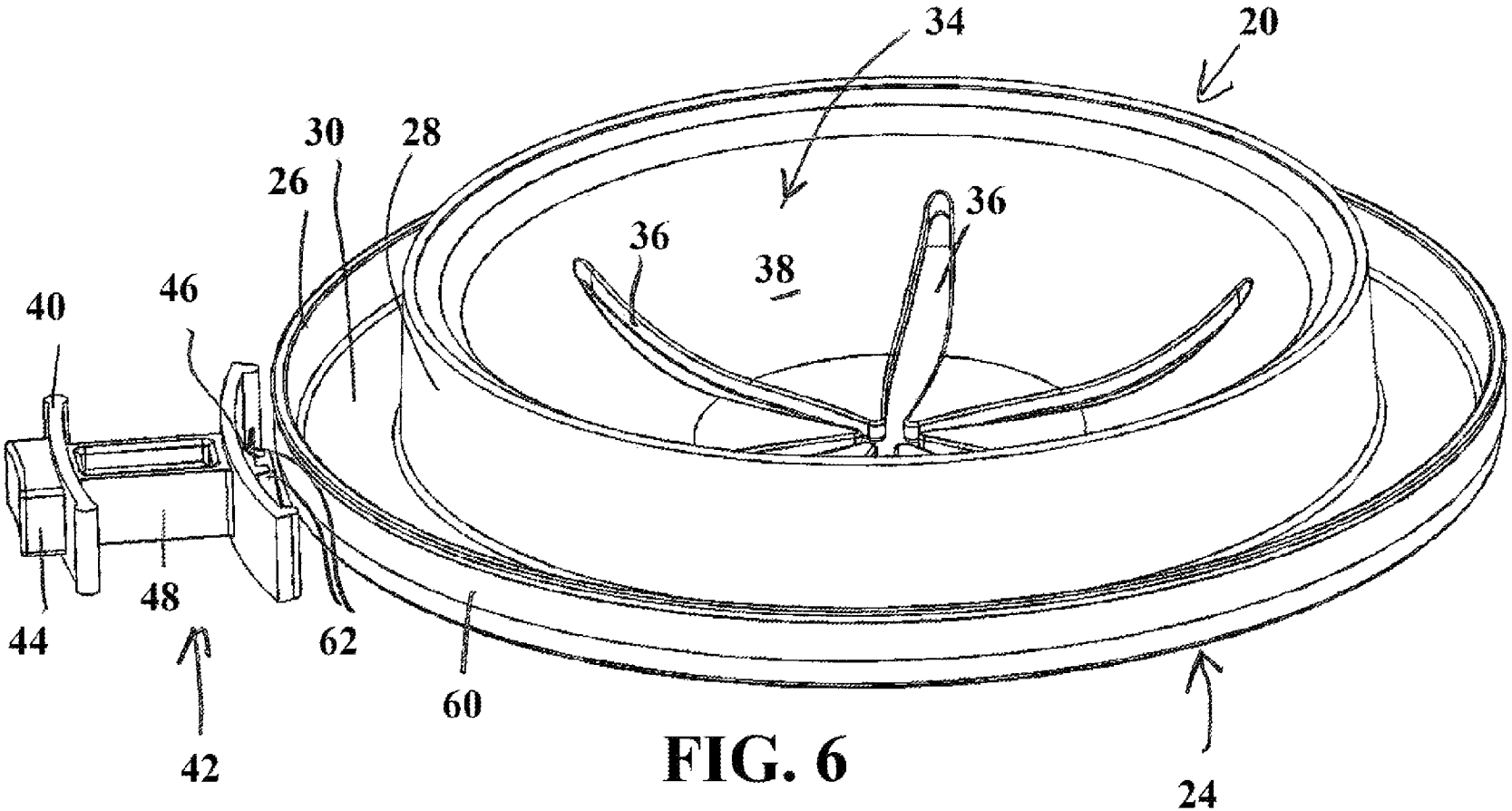
FIG. 6 is a perspective view showing engagement of a third embodiment of a manual control device and a twisting assembly in the waste disposal device shown in FIG. 1.
Figure 8:
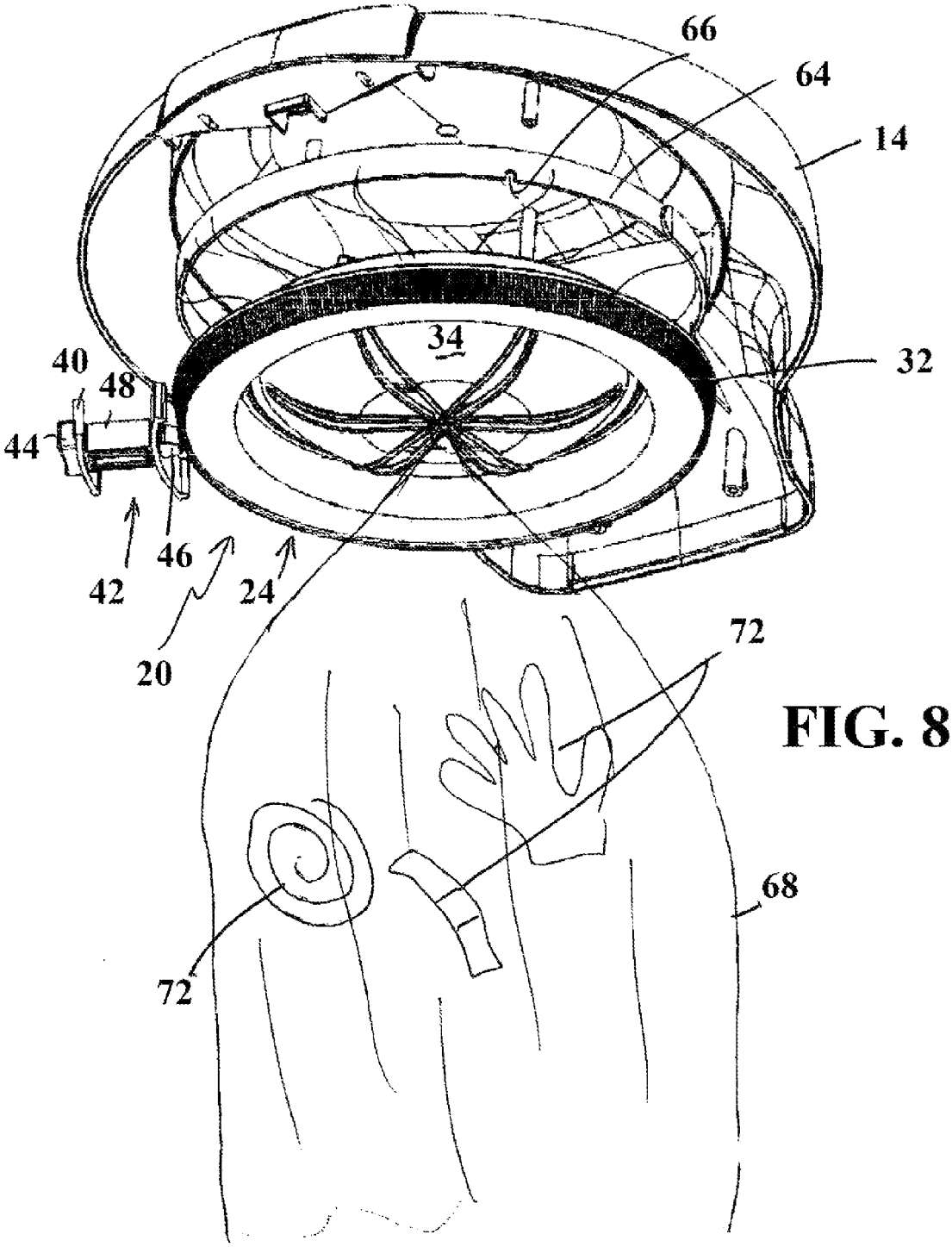
FIG. 8 is a view of the waste disposal device during use showing a bag without a twist or knot.
Figure 9:
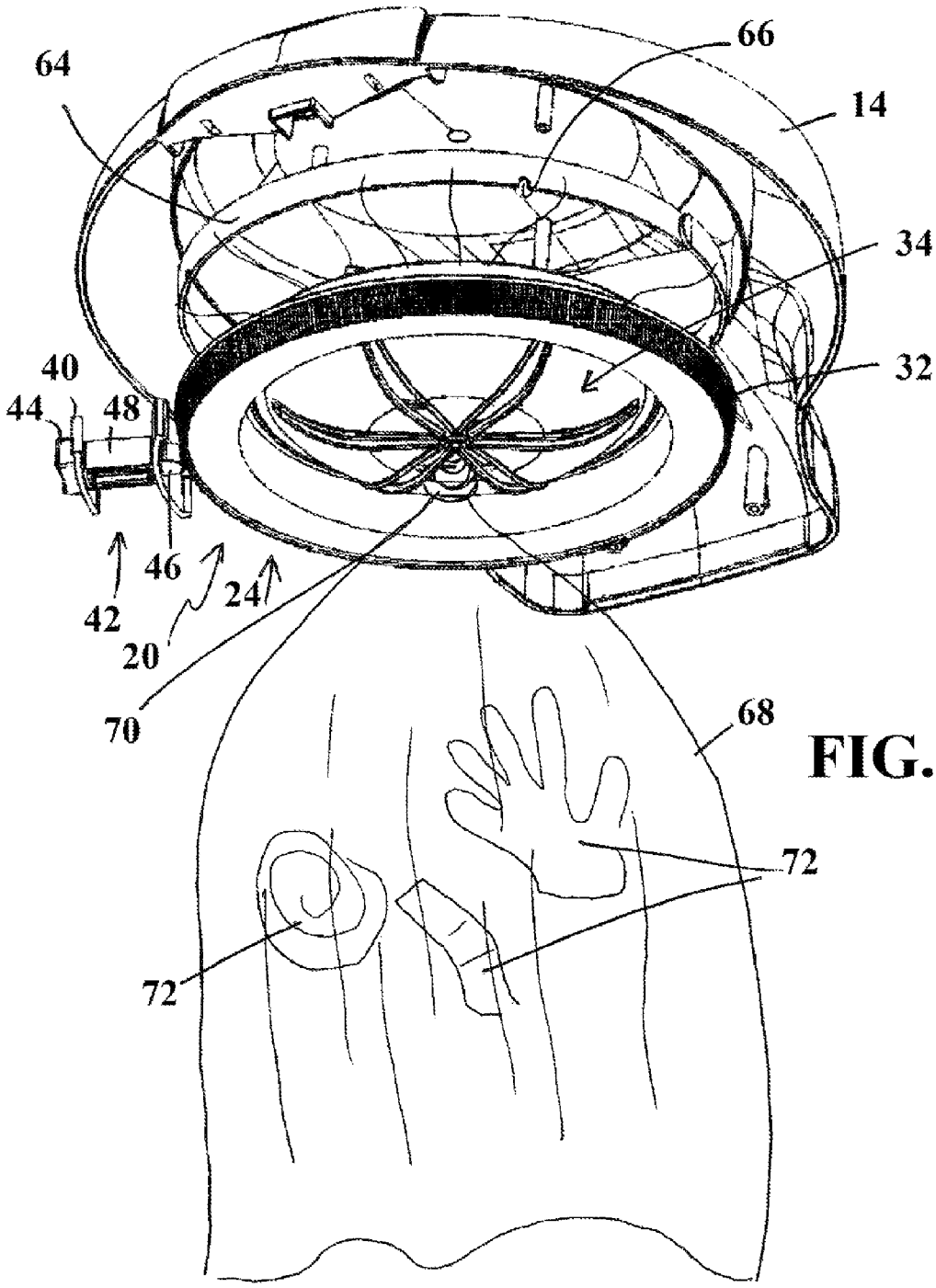
FIG. 9 is a view of the waste disposal device during use showing a bag with a twist or knot.

The twisting assembly 20 seen in FIGS. 4-6 also includes a grasping member such as a membrane 34, 34', 34", 34''' (in any one of the various shapes shown in FIGS. 12-14) arranged to engage with bag or tubing 68 (see FIGS. 8 and 9). When the twisting assembly 20 is rotated, the engagement of the membrane 34, 34', 34", 34''' with the bag or tubing causes the bag or tubing to be twisted, i.e., form a twist 70 in the bag or tubing 68 (see FIG. 9). When the twisting assembly 20 is rotated, the engagement of the membrane 34, 34', 34", 34''' with the bag or tubing may also causes the bag or tubing to be partially or completely untwisted, i.e., form an "untwist" in the bag or tubing 68 (see FIG. 10). The engagement of the bag or tubing 68 (see FIGS. 8-11) with the membrane 34, 34', 34", 34''' arises since the bag or tubing 68 passes through one or more of the slots 36, 36', 36", 36''' between fingers 38, 38', 38", 38''' of the membrane 34, 34', 34", 34'''. (see, for example, FIGS. 12-14) The slots 36, 36', 36", 36''' (see FIGS. 4, 6 and 12-14) define an aperture through which the bag or tubing 68 passes. Additional details about the twisting assembly 20 may be found in U.S. patent application Ser. No. 12/172,715 by the same inventor, and other patents and patent applications by the same inventor mentioned above, such as U.S. patent application Ser. No. 12/637,252, that are all incorporated by reference herein.

Waste disposal device 10 provides for manual rotation of the twisting assembly 20. Various means and mechanisms are envisioned that can enable a person to manually exert a rotational force on the twisting assembly, such that the waste disposal device may be operable without automatic rotation of the twisting mechanism that is prevalent in waste disposal devices disclosed in the patent applications mentioned herein and that are also incorporated by reference herein. An exemplifying mechanism is shown in the illustrated embodiment and comprises a controller or actuator 42 (best seen in FIG. 7). Generally, actuator 42 includes a manual contact portion 44, a twisting assembly engagement portion 46 and a connecting portion 48 that connects the manual contact portion 44 to the twisting assembly engagement portion 46 (see FIG. 7). The manual contact portion 44 is arranged in an elongate slot 50 (see FIGS. 1 and 3) on the tubular wall 16 to enable a user to engage with (by contact) and slide or otherwise move the actuator 42 in the longitudinal direction of the slot 50 (see FIG. 1). The twisting assembly engagement portion 46 is arranged to selectively contact the twisting assembly 20 in general and the gear rim so that when the user slides or otherwise moves the actuator 42, this sliding or movement is transferred to the twisting assembly 20 and causes rotation of the twisting assembly 20, and thus formation of a twist or knot 70 in the bag or tubing 68 (see FIG. 9) or the untwisting of a twist or knot in the bag or tubing 68 to provide the state shown in FIGS. 8 and 10.

Actuator 42 also includes a spring 52 adjacent the twisting assembly engagement portion 46 and that is arranged to contact the support flange 22 of the container 12 when the actuator 42 is pressed against the twisting assembly 20. Spring 52 is in the form of a deflection spring having two edge parts 54 extending in opposite directions from a base 56 (see FIGS. 4 and 7). When the actuator 42 is pressed inward into the container 12 and into engagement with the outer wall 26 of the twisting member 24 of the twisting assembly 20, the edge parts 54 of the spring 52 contact a surface of the support flange 22 and are flexed outward, against their normal curvature (see FIG. 3). Then, when the user ceases to maintain the pressing of the actuator 42 against the outer wall 26 of the twisting member 24, the spring 52 returns to its normal state, i.e., flexes inward, and thereby removes the twisting assembly engagement portion 46 from contact with the outer wall 26 of the twisting member 24 (see FIG. 2). The actuator 42 is thus freely movable in the slot 50. When the spring 52 flexes inward, the actuator 42 is urged radially outward and this radial outward movement is restricted by the presence of a flange 40 (see FIGS. 4-6) that limits the radial outward movement of the actuator 42 by contact the inner surface of the container 12.

Variations of the spring 52 are also envisioned and it should therefore be considered as a type of biasing member that biases the actuator 42 to a first position in which the twisting assembly engagement portion 46 is situated so that it is not in engagement with the twisting assembly 20 and therefore freely movable in the slot 50. In the alternate, second position, the actuator 42 would be pressed by the user against the bias of the biasing member into contact or engagement with the twisting assembly 20.

Several variations of the twisting assembly engagement portion 46 are envisioned, dependent on the formation of the outer wall 26 of the twisting member 24 of the twisting assembly 20.

As shown in FIG. 4, the twisting assembly engagement portion 46 includes a series of teeth or projections 58 which are designed to engage with the gear rim 32 formed on the outer wall 26 of the twisting member 24. The pitch of the teeth on the gear rim 32 and the teeth or projections 58 is equal or substantially equal to provide a secure, geared engagement therebetween which will convert the manually-derived sliding or other movement of the actuator 42 into rotation of the twisting assembly 20, while the actuator 42 is engaged with the twisting assembly 20.

As shown in FIG. 5, the outer wall 26 of the twisting member 24 may be provided with, instead of a gear rim, a covering 60 of slightly pliable material, such as a rubberized material or another soft durometer material. In this embodiment, the teeth 58 will slightly penetrate into the covering 60, i.e., dig a little bit into, and provide for a positive engagement between the twisting assembly engagement portion 46 and the covering 60 and thus allow for translation of the sliding or other movement of the actuator 42 into rotation of the twisting assembly 20 (see FIGS. 4-6).

Covering 60 may be over-molded onto or as part of the outer wall 26 of the twisting member 24. Alternatively, the covering 60 may be insert-molded onto or as part of the outer wall 26.

Figure 7:
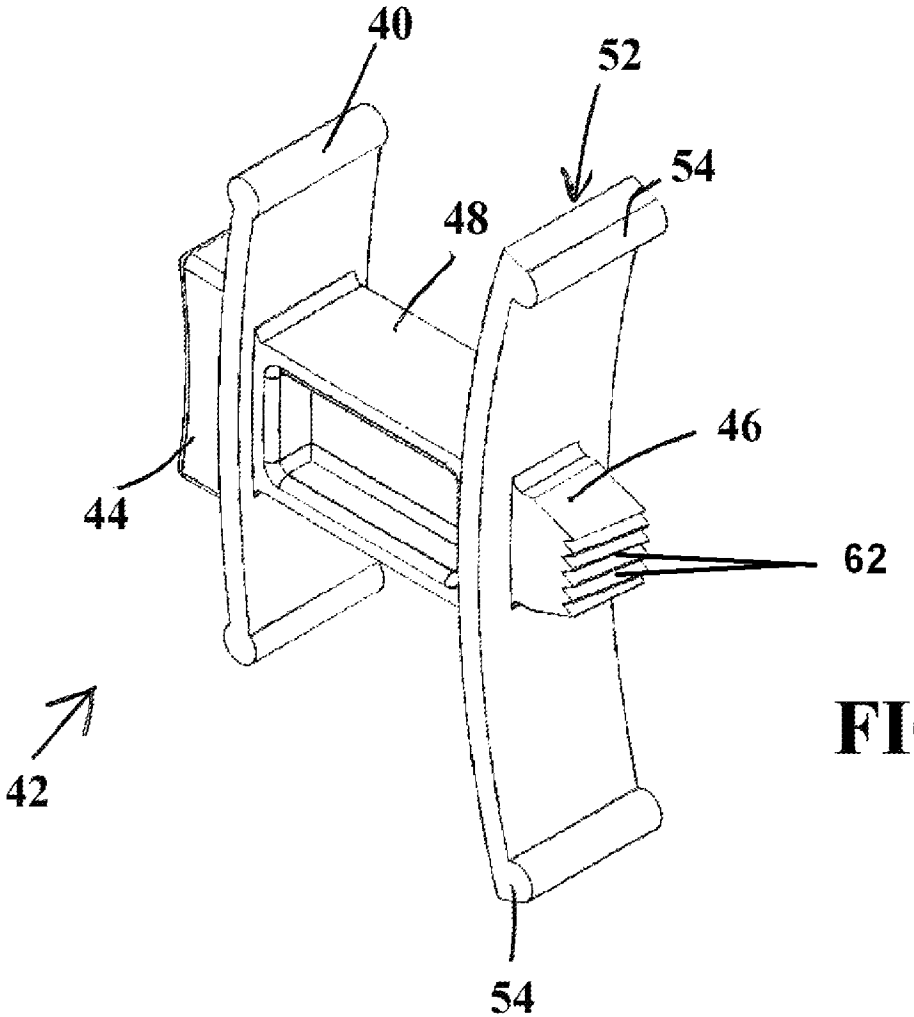
FIG. 7 is a perspective view of an actuator in the waste disposal device in accordance with the invention.

As shown in FIGS. 6 and 7, the twisting assembly engagement portion 46 may include one or more projections 62 which are designed to frictionally engage the covering 60 formed on the outer wall 26 of the twisting member 24. This frictional engagement establishes a temporarily connection between the actuator 42 and the twisting assembly 20 so that the manually-derived sliding or other movement of the actuator 42, while engaged with the twisting assembly 20, is converted into rotation of the twisting assembly 20. Each projection 62 may be in-molded and formed of plastic or a rubberized material. In this case, there may be no gears or teeth involved in the engagement of the twisting assembly engagement portion 46 of the actuator 42 and the twisting assembly 20.

For use, the waste disposal device 10 includes a bag or tubing support 64 that is placed onto, around or above the twisting assembly 20 and includes a mechanism to prevent its rotation when the twisting assembly 20 is rotated (see FIGS. 2 and 3). This is useful primarily when the bag or tubing support 64 is substantially circular or round and thus capable of rotation on its support (and much less important when the bag or tubing support 64 has a non-circular form and thus less likely to be able to rotate on its support). In the illustrated embodiment, this rotation prevention mechanism is the formation of one or more protrusions 66, on the substantially circular bag or tubing support 64 shown in FIGS. 2 and 3, and more particularly formed in a lower surface of the bag and tubing support 64 and that is each received in a corresponding projection formed in the support flange 22 of the container 12. This corresponding projection or projections in or on the support flange 22 of the container 12 are not shown but their position and additional details of variations thereof are amply disclosed in the applications referenced above. With this structure, and when the protrusions 66 are seated on and receive the projections, the bag and tubing support 64 does not rotate when the twisting assembly 20 rotates in one direction and thereby enables the formation of a twist or knot 70 in a bag or tubing 68 when the twisting assembly 20 rotates (see FIG. 9). Similarly, the bag and tubing support 64 does not rotate when the twisting assembly 20 rotates in an opposite direction and thereby enables the untwisting of a previously formed twist or knot 70 in a bag or tubing 68 when the twisting assembly 20 rotates.

With the above structure, a waste disposal device with manual control over rotation of a twisting assembly is possible. The manual control is advantageous in several situations.

For example, after a waste insertion, and before the lid is closed, the user may want to form a tighter twist or knot 70 in the bag or tubing 68. This serves several purposes, for example, to keep airborne bacteria and gaseous odor from migrating from the waste 72 in the bag 68 to the inside of the lid 14, to keep odor and bacteria inside the bag 68, and to prevent a vacuum draft common to conventional waste disposal devices and bio-hazard pails when the lid 14 is subsequently opened (explained more fully below).

Therefore, the user would press their finger or hand against the actuator 42, position it in the slot 50 (either at a first end of the slot 50, at a second end of the slot 50 or in a middle of the slot 50 depending on the desired direction and magnitude of rotation of the twisting assembly 20) urge the actuator 42 forward into engagement with the outer wall 26 of the twisting member 24 and then slide the actuator 42 in the slot 50 toward one end of the slot 50. This sliding movement effects a twist or knot 70 (see FIGS. 9 and 11).

When the actuator 42 is not pressed into engagement with the twisting assembly 20, it can be freely moved in the slot 50. In this manner, if the twisting assembly 20 rotates in a first direction to form a twist, the user can position the actuator 42 in the slot 50 to enable it to move the full length of the slot 50, or only a portion thereof, when in engagement with the twisting assembly 20 to cause rotation of the twisting assembly 20 in the first direction, thereby forming a tighter twist or knot 70 as shown in FIG. 9. The user can even repeatedly move the actuator 42 in the slot 50, whereby once one movement in the slot 50 is finished, the user releases pressure against the actuator, causing the actuator 42 to be urged out of engagement with the twisting assembly 20 and thus once again freely movable. The user moves the actuator 42 in the slot 50 to provide for the desired subsequent sliding movement, re-engage the actuator 42 with the twisting assembly 20 and then while maintaining the actuator 42 in engagement with the twisting assembly 20, sliding the actuator in the slot 50. The user is thus able to control both the magnitude of rotation of the twisting assembly 20, by virtue of the ability to both position the actuator 42 anywhere along the length of the slot 50 and perform repeated slidings of the actuator 42 in the slot 50 (temporally separated from one another).

Figure 10:
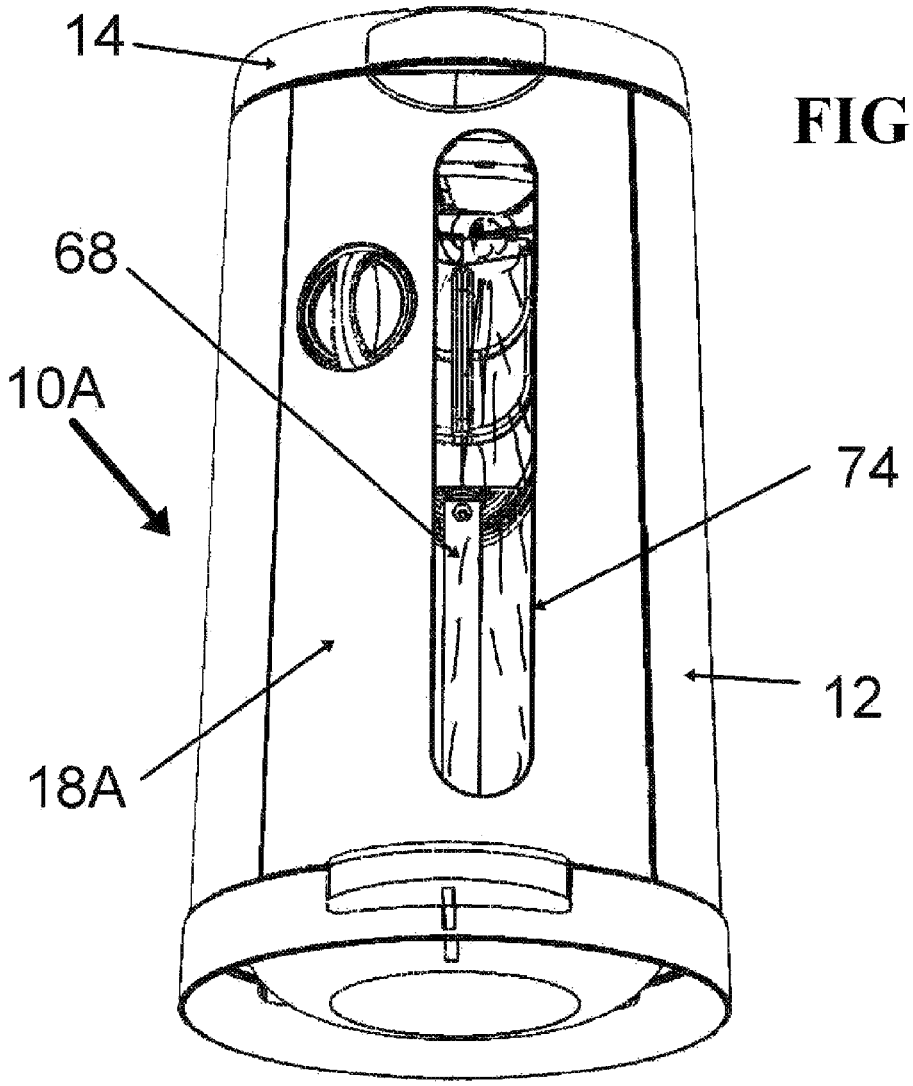
FIG. 10 is a view of the waste disposal device during use showing a bag with an un-twist partially viewable through a window in a side of the waste disposal device.
Figure 11:
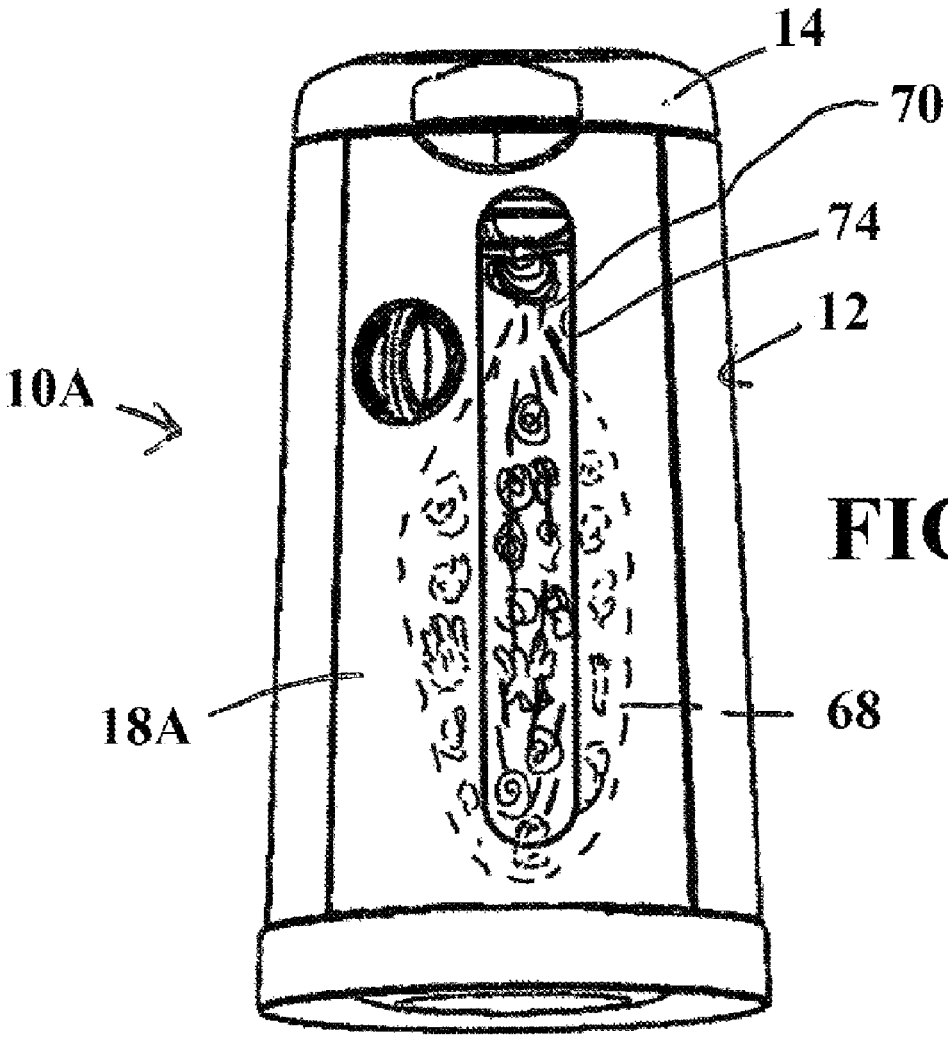
FIG. 11 is a view of the waste disposal device during use showing a bag with a twist containing waste partially viewable through the window.

Referring now to FIGS. 10 and 11, this embodiment of a waste disposal device 10A includes all of the same features as waste disposal device 10 except for a variant of access door 18 (and thus the same reference numbers refer to the same elements). Waste disposal device 10A includes an access door 18A that has a see-through window 74. The shape of the window 74 may be varied from that shown, i.e., differ from the vertically oriented elongate shape with curved upper and lower ends shown in FIGS. 10 and 11. The main purpose of the access door 18A with a window 74 is to enable a user of the waste disposal device 10A to view the status of the bag 68 as well as the status of any twist 70 in the bag 68 through the window 74. Thus, the user can view the bag 68 before opening the lid 14 to ascertain whether the bag 68 has a twist 70 or not. In this manner, if the user sees that there is no twist 70 in the bag 68, they can manipulate the manual control mechanism, i.e., actuator 42, to form a twist before opening the lid 14 so that when the lid 14 is opened, there is a twist 70 in the bag 68. Otherwise, if the lid 14 is opened without a twist 70 in the bag 68, there will be a vacuum sucking of (malodorous) air from the interior of the bag 68 into the room. As such, enabling the user to view the status of the opening of the bag 68, and form a twist if not already present, can prevent odor and bacteria, and other airborne matter, from being urged into the room from the bag 68. Also, seeing the twist 70 in the bag 68 with the lid 14 closed insures that bacteria will not migrate and contaminate the upper inside surface or area of the lid 14. Also, the presence of the window 74 lets a user know when it's time to change bags 68. Here, the user will only need to open the door 18A once for safe removal, as opposed to having to open the door 18 several times to ascertain how full the bag 68 is. Repeated unnecessary door openings and closings produce more engagement (contact) with odor and bacterial than is needed. The window 74 solves these problems.

The vacuum sucking of air from a waste disposal device into the room when the lid of the waste disposal device is opened occurs in conventional waste disposal devices so that odor and bacteria are unavoidably urged into the air.

In contrast to conventional waste disposal devices, by providing a window 74 in the container 12, and preferably in the access door 18A that enables access to the interior of the container 12, and thereby enabling a user to view the status of the twisted or untwisted state of the bag 68 via the window 74 in the waste disposal device 10A in accordance with the invention (see FIG. 11), it is possible for a user to guarantee that whenever the lid 14 is in a closed state, there is a twist 70 in the bag 68. This prevents migratory airborne matter from accumulating on the inner portion of the lid 14 when the lid 14 is in its closed state, which may occur if there is no twist 70 in the bag 68 (in this area of the lid 14, bacteria and fungus will typically fester in conventional waste disposal devices). The twist 70, or knot, keeps odor and bacteria in the bag 68 and prevents harmful bacteria and fungus from festering on the upper regions of the lid 14.

Once the lid 14 is opened however, the user can then untwist the bag 68 by manipulating actuator 42, opening the twist 70, without disturbing or agitating the airborne matter. The actuator 42 therefore provides the user with added control over minimizing migratory common and harmful airborne matter. The ability to manually control the presence of a twist 70 or knot in the bag 68 via actuator 42 therefore allows a user to optimally use the waste disposal device 10A in accordance with the invention to minimize the possibility of odor and bacteria emanating from the bag 68 and passing into the space around the waste disposal device.

In another situation, the user may want to release the twist or knot 70 in the bag or tubing 68 prior to inserting a waste item 72 to avoid the possibility of the user coming into contact with the bag or tubing 68 that has waste items 72 thereon from a previous waste insertion when they push a new waste insertion into and possibly through the twist into the bag or tubing. This may be especially useful in a waste disposal device that has a twisting assembly 20 with a wide mouth membrane 34 (see, e.g., FIGS. 12 and 14) that enables waste to be inserted into the bag 68 without the user coming into contact with the bag 68, i.e., a hands-free insertion of waste into the bag 68 that constitutes essentially a dropping of the waste into the bag 68.

In this case, the user can position the actuator 42 in the slot 50 to cause, when the actuator 42 engages the twisting assembly 20, rotation of the twisting assembly 20 in an opposite direction to the direction in which the twisting assembly 20 rotates when forming a twist or knot 70. This will cause a variable release of the twist or knot 70, depending on the length of the sliding movement of the actuator 42 in the slot 50 determined by the user and the number of sliding movements (which may be effected as described immediately above), as shown in FIG. 8.

The actuator 42 is bi-directional. i.e., twist or un-twist is achieved in either direction. In other words, a knot or unwinding or untwisting of a previously formed knot is achieved by moving the actuator 42 in one direction (whether left or right) while twisting of the bag or tubing to form a knot is achieved by moving the actuator 42 in the opposite direction. A user may find it useful to unwind or untwist a knot when they want the waste inserted with less urging through the bag or tubing 68 entrained in the membrane 32.

Figure 12:
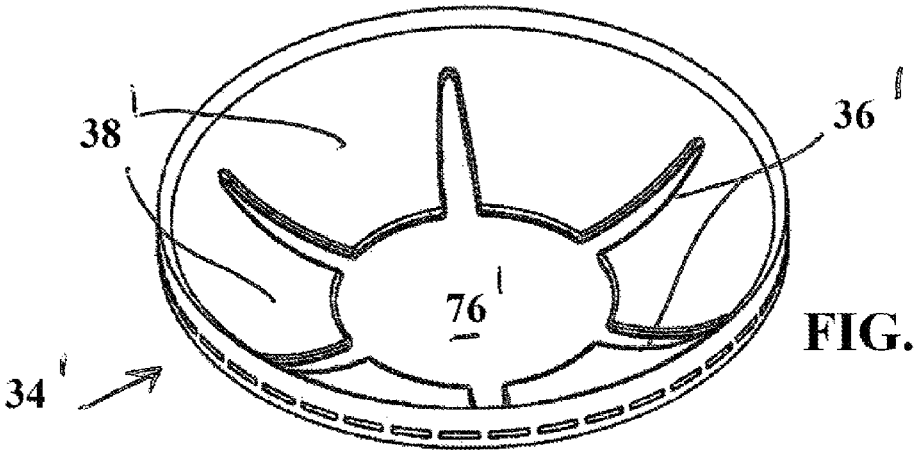
FIGS. 12-14 show several membranes having different throat openings for different applications and use in a waste disposal device in accordance with the invention.
Figure 13:
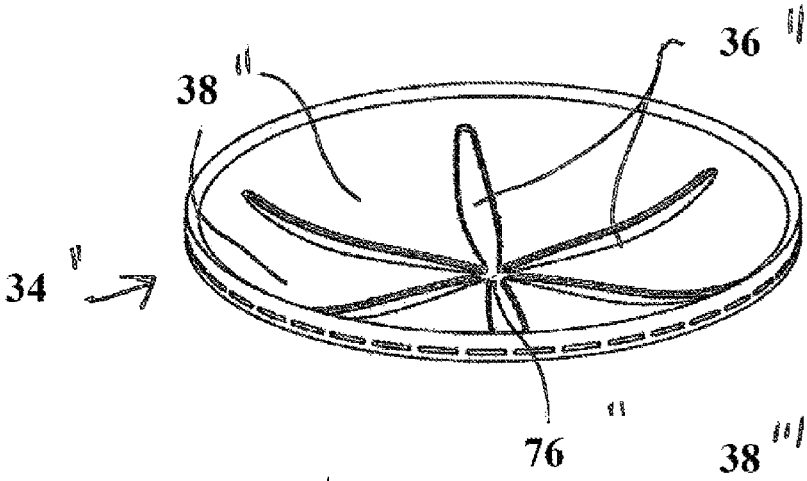
Figure 14:
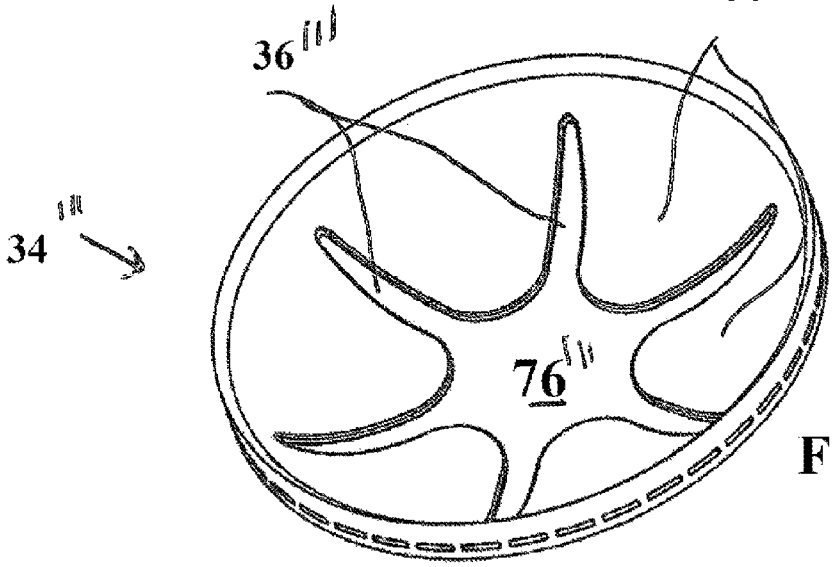

Different membranes, shown in FIGS. 12-14, may be provided for the twisting assembly 20. In one embodiment of the membrane 34", the central aperture 76" is small (see FIG. 13) whereas in other embodiments 34', 34'", there is a larger central aperture 76', 76'" (see FIGS. 12 and 14). The particular membrane used may depend on the type of waste products, e.g., larger waste products such as adult incontinence diapers and medical waste products such as non-sharp disposables and the like, may require the membrane with the larger central aperture, as well as for "Hands Free" applications, while small may be better suited for the membrane with the smaller aperture such as baby diapers for controlling odor. Of course, the selection of which twisting assembly 20 with a particular membrane 32 to use is entirely up to the user. It is envisioned however, that multiple and different membranes (see FIGS. 12-14) may be provided for use with all of the components of the waste disposal devices 10 remaining the same. Indeed, a kit may be sold with the waste disposal device 10 and multiple membranes, with instructions on which to use for particular waste. The user can then interchange the membrane depending on when they are using the waste disposal device for whichever type of waste.

Referring to FIGS. 8 and 10, FIGS. 8 and 10 show the bag or tubing 68 in a neutral un-twisted position with the bag or tubing 68 unknotted. Thus, a knot may be made by moving the actuator 42 in either direction. Actuator 42 can start at the left of slot 50, be pressed to engage the twisting assembly 20 and move to the right, or start at the right of slot 50, be pressed to engage the twisting assembly 50 and move to the left. Either direction will cause a knot 70 in the bag or tubing 68 (see FIG. 9) as long as the bag or tubing 68 started out unknotted as seen in FIGS. 8 and 10. After each insertion (knotted or un-knotted), the bag or tubing 68 is back to neutral (opened). As such, the user has the option to move the actuator 42 in either direction to create the knot 70 as seen in FIG. 9.

In another situation, the user may keep the lid 14 open and perform multiple waste insertions. In this case, the user could manipulate the actuator 42 to untwist the bag or tubing 68, or insert a first waste insertion in a manner to cause a slight untwisting of the bag or tubing 68 (see FIGS. 8 and 10). Then, the user could re-position the actuator 42 to enable formation of a twist or knot after the first waste insertion, while keeping the lid 14 open. The user could then re-position the actuator 42 and manipulate it to cause the bag or tubing to untwist, or insert a second waste insertion in a manner to cause a slight untwisting of the bag or tubing. Then, the user could re-position the actuator 42 to enable formation of a twist after the second waste insertion, while keeping the lid 14 open. The user could repeat these waste insertions and exert manual control over the twists and untwistings as desired. The actuator 42 thus provides bi-directional rotation control of the twisting assembly 20 enabling the user to both twist the bag or tubing and untwist the bag or tubing.

Accordingly, twist of the bag or tubing may be achieved in both directions, via clockwise or counterclockwise rotation of the twisting assembly 20.

Furthermore, a twist may be achieved in either direction before the knot is made. Before the knot 70 is made, the membrane 34 and the bag or tubing 68 are in the open position. In other words, a knot can be made if the actuator 42 is slid in the opposite direction of where it is. As such, a knot is made when the bag or tubing 68 and membrane 34 are unknotted. On the other hand, the actuator 42 is capable of unwinding an existing knot, thus bringing it back to the open position. Therefore, the actuator 42 is capable of making a knot in either direction, as well as unwinding a knot for certain applications where insertion to unwind a knot is minimized.

Moreover, the actuator 42 can be used when the lid 14 is closed or open, i.e., in a closed state or in an open state. That is, the user can decide that after the lid 14 has been closed, it might be safer to unwind the knot in the bag or tubing for subsequent waste insertions when the lid 14 is in the open position. When the lid 14 is in its closed state, the user can contain potentially hazardous or odorous matter, etc., additionally to prevent the vacuum effect described above when the lid 14 is subsequently opened. The user thus has a choice to rotate the mechanism, i.e., the actuator 42, either way when the lid 14 is in its closed state.

The elongate slot 50 in combination with the actuator 42 having a condition in which it is freely movable in the slot 50 or in engagement with the twisting assembly 20, provides a user with broad, manual control over rotation of the twisting assembly 20 and thus the presence and formation of a twist in the bag or tubing extending through the twisting assembly 20.

Instead of the slot and actuator, other mechanisms that achieve manual control over the presence and formation of a twist in a bag or tubing via selective manual engagement with the twisting assembly are also contemplated to within the scope and spirit of the invention.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. Further, any of the waste disposal device features disclosed in the inventor's other patent applications mentioned above may be incorporated into the waste disposal devices disclosed herein, to the extent there is no conflict, and such combinations are encompassed within the scope and spirit of the disclosed inventions herein, and considered as inventions by the inventor.

The invention claimed is:

1. A waste disposal device, comprising:

a container defining a waste-receiving compartment having an opening;

a lid connected to said container, said lid having a first, closed position covering said opening of said container and a second, open position in which said opening is exposed;

a twisting assembly arranged in said container to engage with and twist or untwist a bag or tubing that extends through said twisting assembly and into which waste is inserted; and a manual actuator having a first position in engagement with said twisting assembly and a second, different position out of engagement with said twisting assembly, said manual actuator being manually switchable in a first direction of movement between said first and second positions, said manual actuator being arranged to selectively engage with said twisting assembly such that movement of said manual actuator, in a second direction of movement different than the first direction of movement and while said manual actuator is in said first position, causes rotation of said twisting assembly in at least one direction and movement of said manual actuator, in the second direction and while said manual actuator is in said second position, does not cause rotation of said twisting assembly.

2. The device of claim 1, wherein said container comprises a support flange defining said opening, said twisting assembly being movably seated on said support flange and comprising a twisting member having an outer wall, said actuator being arranged to contact said outer wall of said twisting member when in said first position.

3. The device of claim 2, wherein said outer wall of said twisting member includes a series of teeth formed thereon to thereby constitute a gear rim, said actuator including a twisting assembly engagement portion having a series of teeth or projections that contact said gear rim when said actuator is in said first position.

4. The device of claim 2, further comprising a covering on said outer wall of said twisting member and made of a pliable material, said actuator including a twisting assembly engagement portion having a series of teeth or projections that contact said covering when said actuator is in said first position.

5. The device of claim 2, further comprising a covering on said outer wall of said twisting member and made of a pliable material, said actuator including a twisting assembly engagement portion having at least one projection to that frictionally contacts said covering when said actuator is in said first position.

6. The device of claim 1, wherein said actuator incorporates a spring that biases said actuator into the second position such that when manual force is not applied to said actuator, said actuator is in said second position.

7. The device of claim 1, wherein said container includes an elongate slot on an outer wall of said container, said actuator including a manual contact portion slidable in said slot, a twisting assembly engagement portion that contacts said twisting assembly when said actuator is in said first position, a connecting portion that connects said manual contact portion to said twisting assembly engagement portion, and a spring adjacent said twisting assembly engagement portion and that biases said actuator into said second position such that when manual force is not applied to said actuator, said actuator is in said second position.

8. The device of claim 7, wherein said container comprises a support flange defining said opening, said twisting assembly being movably seated on said support flange, said spring contacting said support flange when said actuator is in said first position, said spring being in the form of a deflection spring having two edge parts extending in opposite directions from a base, whereby when said actuator is pressed into contact with said twisting assembly, said edge parts contact a surface of said support flange and are flexed outward against their normal curvature, and when pressure on said actuator is released, said spring returns to its normal state and thereby removes said twisting assembly engagement portion from contact with said twisting assembly to enable said actuator to be freely movable in said slot.

9. The device of claim 7, wherein said actuator is slidable in two opposite directions in said slot to thereby enable:

the bag or tubing to be twisted when the bag or tubing is engaged with said twisting assembly by moving said actuator in a first direction while said actuator is in said first position and a previously formed twist or knot in the bag or tubing to be untwisted or unknotted when the bag or tubing is engaged with said twisting assembly by moving said actuator in a second direction in said slot opposite to said first direction while said actuator is in said first position.

10. The device of claim 1, further comprising a support member that supports the bag or tubing and that is arranged in said container in a position to enable waste to be inserted into the bag or tubing, said container including a mechanism to prevent rotation of said support member when said twisting assembly rotates.

11. The device of claim 1, wherein said container comprises a transparent window that enables viewing of an interior of said container and is arranged relative to said twisting assembly such that when a bag is engaged with said twisting assembly, a twist or knot in said bag formed by said twisting assembly is viewable through said window.

12. A waste disposal device, comprising:

a container defining a waste-receiving compartment having an opening, said container including an outer wall having an elongate slot;

a lid connected to said container, said lid having a first, closed position covering said opening of said container and a second, open position in which said opening is exposed;

a twisting assembly arranged in said container to engage with and twist or untwist a bag or tubing that extends through said twisting assembly and into which waste is inserted; and a manual actuator movable in said slot in a radial direction into and out of engagement with said twisting assembly, said manual actuator being arranged to selectively engage with said twisting assembly such that movement of said manual actuator longitudinally in said slot in at least one direction while said manual actuator is in engagement with said twisting assembly causes rotation of said twisting assembly and movement of said manual actuator longitudinally in said slot while said manual actuator is out of engagement with said twisting assembly does not cause rotation of said twisting assembly.

13. The device of claim 12, wherein said container comprises a support flange defining said opening, said twisting assembly being movably seated on said support flange and comprising a twisting member having an outer wall, said actuator being arranged to contact said outer wall of said twisting member when said actuator is in engagement with said twisting assembly.

14. The device of claim 13, wherein said outer wall of said twisting assembly includes a series of teeth formed thereon to thereby constitute a gear rim, said actuator including a twisting assembly engagement portion having a series of teeth or projections that contact said gear rim when said actuator is in engagement with said twisting assembly.

15. The device of claim 13, further comprising a covering on said outer wall of said twisting member and made of a pliable material, said actuator including a twisting assembly engagement portion having a series of teeth or projections that contacts said covering when said actuator is in engagement with said twisting assembly.

16. The device of claim 13, further comprising a covering on said outer wall of said twisting member and made of a pliable material, said actuator including a twisting assembly engagement portion having at least one projection that frictionally.

17. The device of claim 12, wherein said actuator incorporates a spring that biases said actuator out of engagement with said twisting assembly such that when manual force is not applied to said actuator, said actuator is out of engagement with said twisting assembly.

18. The device of claim 12, wherein said actuator includes a manual contact portion slidable in said slot, a twisting assembly engagement portion that contacts said twisting assembly, a connecting portion that connects said manual contact portion to said twisting assembly engagement portion, and a spring adjacent said twisting assembly engagement portion and that is biases said actuator out of engagement with said twisting assembly such that when manual force is not applied to said actuator, said actuator is out of engagement with said twisting assembly.

19. The device of claim 18, wherein said container comprises a support flange defining said opening, said twisting assembly being movably seated on said support flange, said spring contacting said support flange when said actuator is in engagement with said twisting assembly, said spring being in the form of a deflection spring having two edge parts extending in opposite directions from a base, whereby when said actuator is pressed into engagement with said twisting assembly, said edge parts contact a surface of said support flange and are flexed outward against their normal curvature, and when pressure on said actuator is released, said spring returns to its normal state and thereby removes said twisting assembly engagement portion from contact with said twisting assembly to enable said actuator to be freely movable in said slot.

20. The device of claim 12, further comprising a support member that supports the bag or tubing and that is arranged in said container in a position to enable waste to be inserted into the bag or tubing, said container including a mechanism to prevent rotation of said support member when said twisting assembly rotates.

21. The device of claim 12, wherein said actuator is slidable in two opposite directions in said slot to thereby enable:

the bag or tubing to be twisted when the bag or tubing is engaged with said twisting assembly by moving said actuator in a first direction when said actuator is in engagement with said twisting assembly, and a previously formed twist or knot in the bag or tubing to be untwisted or unknotted when the bag or tubing is engaged with said twisting assembly by moving said actuator in a second direction in said slot opposite to said first direction when said actuator is in engagement with said twisting assembly.

22. The device of claim 12, wherein said container comprises a transparent window that enables viewing of an interior of said container and is arranged relative to said twisting assembly such that when a bag is engaged with said twisting assembly, a twist or knot in said bag formed by said twisting assembly is viewable through said window.

23. A waste disposal device, comprising:

a container defining a waste-receiving compartment having an opening and including a slot on an outer wall of said container;

a lid connected to said container, said lid having a first, closed position covering said opening of said container and a second, open position in which said opening is exposed;

a twisting assembly arranged in said container to engage with and twist or untwist a bag or tubing that extends through said twisting assembly and into which waste is inserted, said twisting assembly comprising an outer wall including a series of teeth arranged thereon to thereby constitute a gear rim; and a manual actuator having a first position in contact with said gear rim of said twisting assembly to enable manual rotation of said twisting assembly and a second position out of contact with said gear rim of said twisting assembly, said manual actuator including a manual contact portion slidable in said slot and adapted to be held and moved by a user of the device, said manual actuator being arranged to selectively contact said gear rim of said twisting assembly such that movement of said manual actuator while said manual actuator is in said first position causes rotation of said twisting assembly in at least one direction and movement of said manual actuator while said manual actuator is in said second position does not cause rotation of said twisting assembly.

* * * * *

UNITED STATES PATENT AND TRADEMARK OFFICE

CERTIFICATE OF CORRECTION

PATENT NO. : 8,266,870 B1
APPLICATION NO. : 13/172968
DATED : September 18, 2012
INVENTOR(S) : David M. Stravitz It is certified that error appears in the above-identified patent and that said Letters Patent is hereby corrected as shown below:

Col. 10, line 57, after "projection", delete "to";
Col. 12, lines 24-25, after "frictionally", insert --contacts said covering when said actuator is in engagement with said twisting assembly--; and
Col. 12, line 37, after "that", delete "is".

Signed and Sealed this
First Day of January, 2013

David J. Kappos

David J. Kappos
*Director of the United States Patent and Trademark Office*